US006598328B2

(12) United States Patent
Aeling et al.

(10) Patent No.: US 6,598,328 B2
(45) Date of Patent: Jul. 29, 2003

(54) SIGN FACES HAVING REFLECTIVE FILMS AND METHODS OF USING SAME

(75) Inventors: Ellen O. Aeling, St. Paul, MN (US); Frank L. Deyak, Stillwater, MN (US); Sanford Cobb, Jr., St. Mary's Point, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/196,039

(22) Filed: Nov. 19, 1998

(65) Prior Publication Data

US 2002/0011016 A1 Jan. 31, 2002

(51) Int. Cl.[7] ..... G09F 19/00

(52) U.S. Cl. ..... 40/615; 40/564; 40/570; 40/572; 40/582

(58) Field of Search ..... 40/564, 570, 572, 40/580, 582, 615; 362/812

(56) References Cited

U.S. PATENT DOCUMENTS

| | | | | | |
|---|---|---|---|---|---|
| 3,324,290 | A | * | 6/1967 | Lasker | 40/570 X |
| 3,448,538 | A | * | 6/1969 | Maze | 40/572 X |
| 3,510,976 | A | * | 5/1970 | Pauline et al. | 40/564 |
| 3,694,945 | A | | 10/1972 | Detiker | 40/133 R |
| 4,005,538 | A | * | 2/1977 | Tung | 40/582 X |
| 4,373,283 | A | | 2/1983 | Swartz | 40/564 |
| 4,539,256 | A | | 9/1985 | Shipman | 428/315.5 |
| 4,567,072 | A | * | 1/1986 | Brainard et al. | 428/40 |
| 5,009,019 | A | * | 4/1991 | Erlendsson et al. | 40/541 |
| 5,047,907 | A | * | 9/1991 | Hawkins | 40/570 X |
| 5,141,790 | A | | 8/1992 | Calhoun et al. | 428/40 |
| 5,229,207 | A | | 7/1993 | Paquette et al. | 428/355 |
| 5,296,277 | A | | 3/1994 | Wilson et al. | 428/40 |
| 5,297,011 | A | * | 3/1994 | Triunfol | 362/147 |
| 5,362,516 | A | | 11/1994 | Wilson et al. | 427/207.1 |
| 5,414,947 | A | | 5/1995 | Hjaltason | 40/615 |
| 5,428,912 | A | * | 7/1995 | Grondal et al. | 40/570 |
| 5,509,223 | A | * | 4/1996 | Jung | 40/564 |
| 5,542,201 | A | * | 8/1996 | Grondal et al. | 40/570 |
| 5,680,720 | A | * | 10/1997 | Asazuma et al. | 40/615 X |
| 5,800,919 | A | | 9/1998 | Peacock et al. | 428/355 AC |
| 5,918,396 | A | * | 7/1999 | Jung | 40/564 X |
| 5,966,856 | A | * | 10/1999 | Alu | 40/564 |

FOREIGN PATENT DOCUMENTS

| | | | |
|---|---|---|---|
| WO | WO 97/01774 | 1/1997 | G02B/1/10 |
| WO | WO 97/ 18246 | 5/1997 | C08F/2/32 |
| WO | WO 98/39759 | 9/1998 | G09F/15/02 |

* cited by examiner

*Primary Examiner*—Gregory J. Binda
*Assistant Examiner*—James M. Hewitt
(74) *Attorney, Agent, or Firm*—James D. Christoff

(57) ABSTRACT

A lighted sign housing is provided having a sign face with both light-transmissive portions and light-blocking portions; and a reflective film applied to at least a portion of the light-blocking portions toward the interior of the sign housing. A method of using the reflective film is also provided.

9 Claims, 2 Drawing Sheets

SIGN FACES HAVING REFLECTIVE FILMS AND METHODS OF USING SAME

FIELD OF INVENTION

This invention relates to films for use in the signage industry to increase lighting efficiency.

BACKGROUND OF INVENTION

Lighted signs are everywhere in modern countries. The sign can educate, entertain, inform, or warn the viewer. The sign can be designed for close or distant viewing. Lighting is provided to assure the viewer can see the message, particularly during dimly lit days or nighttime.

Lights require energy to power them. Modern countries readily can provide the power, but those who pay for the energy are always seeking more efficient delivery of the power and more efficient usage of the power. The energy required to power a lighted sign should not be wasted for economic and environmental reasons.

Lighted signs can be "front lit" or "back lit". The former typically include such signs as billboards or other displays where the light is directed to the sign face from outside of the sign housing and from the same side of the face as the viewer. The latter typically have a translucent surface through which the light is seen and on which the message or image is placed, most often in a sign housing that is internally illuminated. Uniformity of light emanating from the translucent surface is important. Often, the translucent surface includes some element that diffuses the light to reduce the visibility of the point or linear source of the light within the sign cabinet to the viewer. Moreover, typical back lit signage today allows less than 30% of the light emitted from the light source to escape from inside the sign for viewing. Clearly, a more efficient lighting system is needed.

The lighted sign can be in any configuration. Light sources can be of many types, including neon or cold cathode, fluorescent, incandescent, halogen, high intensity discharge (HID), light emitting diodes (LED), and metal halide. The source may be within the housing, or light transported in from an external source by fiber optics or hollow light pipes. The sign can be integral to a building, mounted as a fixture on a building, freestanding, or a part of other apparatus or equipment. The light can be powered continuously, periodically, episodically, or irregularly. Whenever the sign is lighted, the power used should not be wasted.

The lighted sign housing can be any geometric configuration.

Lighted signs that have a perimeter shape of a complex geometry to convey the intended message are entirely different types of signs from lighted signs that rely on the intended message being on a sign face within the perimeter. In the industry, an example of the former type of sign is called "channel letters" and can generically be called "complex shape lighted signs." The latter are called "sign cabinets" because the perimeter of the sign is irrelevant to the message being conveyed. Generically, both complex shape lighted signs and sign cabinets can be called "sign housings".

Nonlimiting examples of sign cabinets include rectangular, oval, circular, elliptical, and other geometrical shapes. Nonlimiting examples of complex shape lighted signs include letters, profiles, silhouettes, characters, or any other shape desired by a customer that helps to advertise, educate, warn or the like.

Lighting complex shape lighted signs is more difficult than sign cabinets, because even distribution of the light is quite difficult to obtain unless the light source has substantially the same shape as the viewing area of the sign.

In a back lit sign, the second surface (i.e., inside) of the sign face is sometimes lined with a film (such as 3M Scotchcal™ Blockout Films 3635-20B or 3635-22B commercially available from Minnesota Mining and Manufacturing Company (3M) of St. Paul, Minn.) to block the light from passing through parts of the sign face. This would be done to make a sign where some portion of the sign face would be seen by the viewer as being dark (black) in transmitted light and some other color in reflected light. This is accomplished by lining the backside or the front side of the sign face of a back lit sign with an opaque film. The construction of this film usually has two layers: one black and one white, with the black surface facing into the sign housing and the white surface facing toward the viewer. This construction gives maximum opacity. When a sign is so constructed with the black film or surface facing toward the light source(s) in the sign housing, that portion of the surface area of the inside of a sign housing is black, dark, and light absorbing. The light from the light source hits the front face and where the face is light-transmissive some portion of the light passed through and where the front face is light-blocking, the light is mostly absorbed by the black surface. The percentage of the surface area of the back lit sign that is constructed with a light-blocking, absorbing surface is even greater when the back lit sign has two or more surfaces requiring block out film or the like, such as when a back lit sign is a double message sign or kiosk having more than one surface for sign messages or indicia. Indeed, if the back lit sign has three or more sign faces, then almost all the vertical surfaces of the back lit sign may have light-blocking portions of the sign face constructed partially of light absorbing surfaces.

A similar situation exists when the sign face of a sign is constructed with metal or other material that is cutout, in outline form, to provide the areas where light shall pass through the sign face transmissively.

In either form, blockout film or silhouette, those surfaces facing the inside of the sign housing are not as efficient as they could be in reflecting light back into the sign housing so that such light can eventually emerge from the transmissive portions of the sign face.

SUMMARY OF INVENTION

The present invention solves the problems in the art by providing a highly reflective film on the inside or outside surfaces of the sign face where light is intended not to be transmitted beyond the sign face.

Preferably, the reflective film is selected from the group consisting of a diffuse reflective film, a semi-specular reflective film, and a specular reflective film having a diffuse reflective film laminated thereto or a diffused coating coated thereto. "Film" means a thin, flexible sheet in existence prior to contact with sign face or sign housing.

"Highly reflective" means a film having at least about 75% reflective as measured using ASTM E 1164-94.

"Diffuse reflective film" means a film that is reflective without being a mirrored surface. "Reflective" is an adjective of the noun "Reflectivity" which is expressed in an industrial standard established by the American Society for the Testing of Materials (ASTM) in Standard ASTM E1164-94, the publication of which is incorporated herein by reference.

A film of the present invention applied to at least some of the light-blocking portion of an interior surface of a back lit sign face surface captures light from the light source or light reflecting back from sides and backs of the light housing and re-directs such light toward the other surfaces of the sign housing for further re-direction eventually through the light-transmissive portions of the sign face and to the viewer. Further, a film of the present invention provides luminance uniformity on the light-transmissive surface of the sign housing.

One aspect of the present invention is a lighted sign housing, comprising a sign face having both light-transmissive portions and light-blocking portions; and a reflective film applied to at least a portion of the light-blocking portions of the sign face. Preferably, the film comprises a diffuse reflective film having a reflectivity of at least 80% as measured using ASTM E1164-94 and, more preferably, selected from the group consisting of polyolefin films filled with white particles, blends of incompatible polymers, polyolefin multilayer films; polyester multilayer films; microvoided polyolefin and polyester films; fluorinated polyolefin films; vinyl chloride polymeric films filled with white particles; acrylic films filled with white particles; polyolefin films co-extruded with ethylene-vinyl acetate films; and combinations thereof.

Another aspect of the present invention is a method of using a film for signage, comprising the steps of selecting a film according to its reflectivity as measured by ASTM E1164-94; and applying the film to at least a portion of light-blocking portions of a sign face of a lighted sign housing.

A feature of the present invention is that the highly reflective film provides a return to the sign housing of light that would otherwise be absorbed or lost from the ultimate brightness of the sign face intended to viewed from the outside of the sign housing.

Another feature of the invention is the reflectivity of the film can be selected to provide desired power consumption reductions and improved luminance uniformity according to the needs of those skilled in the art of signage construction.

An advantage of the present invention is improvement of luminance uniformity while also providing significant power reduction for a sign, such that both utility and aesthetics of a sign are addressed by a single element within the sign housing.

Another advantage of the present invention is that the present invention uses a material that can improve the efficiency of lighted signs and reduce the power consumption required to display a message in a lighted sign as well as improve the luminance uniformity of the sign.

Optionally, but preferably, the reflective film of the present invention is used in conjunction with diffuse reflective films that line at least a portion of the interior walls of the lighted sign housing, as disclosed in copending, coassigned, U.S. patent application Ser. No. 09/070,380 (Deyak et al.) copending, coassigned, U.S. patent application Ser. No. 08/494,366, diffusely reflecting multilayer polarizers and mirrors (such as those disclosed in copending, coassigned, U.S. patent application Ser. No. 08/927,436, microporous membranes (such as thermally induced phase separated films as disclosed in copending, coassigned, U.S. patent application Ser. No. 08/957,558, the disclosures of which are incorporated by reference herein. Use of film of the present invention increases significantly the surface areas within the sign housing that are improved by using a reflective film for increased brightness, decreased power consumption, or a combination of both.

Further features and advantages are disclosed when identifying the embodiments of the invention in relation to the following drawings.

EMBODIMENTS OF INVENTION

Figure 1:
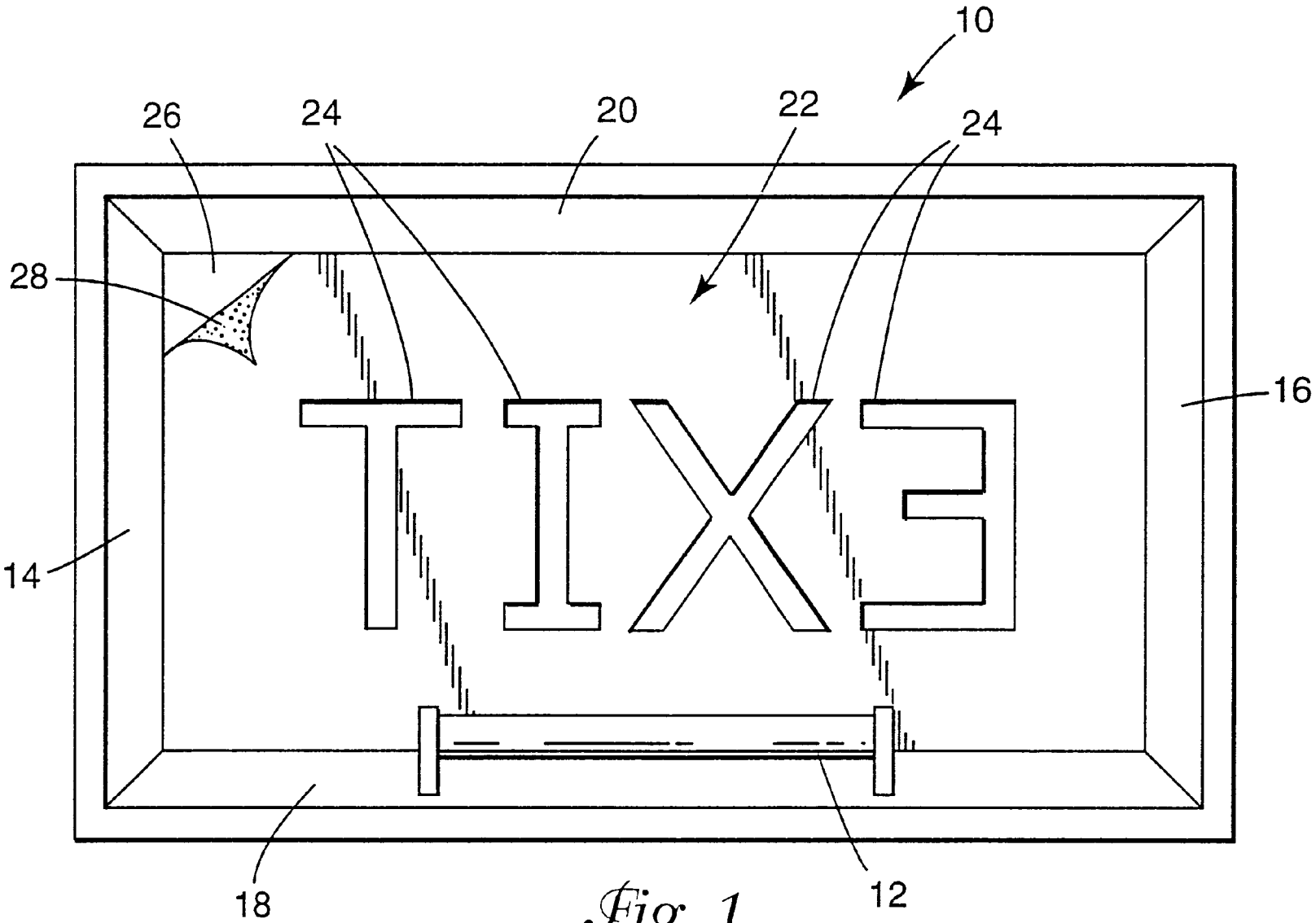
FIG. 1 is a plan view from back of a sign housing forward to a sign face, showing a light source and the sign face having both light-transmissive portions and light-blocking portions.

FIG. 1 shows a sign housing 10 opened from a back examination perspective, with a light source 12 that projects light against sides 14 and 16 and bottom 18 and top 20 as well as sign face 22 having both numerous light-transmissive portions 24 and light-blocking portions 26. Sign face 22 itself can be translucent or opaque. The combination of portions 24 and 26 create the indicia or graphic of the sign seen by the viewer on the opposite side (not shown) of sign face 22. In FIG. 1, the common term "EXIT" would be seen by the viewer based on the position of portions 24 and 26. Film 28 is in contact with portions 26, preferably adhered to such surface as seen in FIG. 1, where a corner of film 28 is lifted from portion 26.

The relative geometries of the light-transmissive portions 24 as compared with the light-blocking portions 26 can be varied according to the need of those skilled in the art. For example, light-transmissive portions 24 can be block letters such as seen in FIG. 1 or a more elaborate graphic that contains multi-colored scenery against an opaque background, as seen by the viewer. Using digitally-controlled cutting equipment such as a Gerber Edge machine (Gerber Scientific Products of Manchester, Conn., USA), one can make very elaborate designs with intricate cutting, wherein light-transmissive portions weeded from the film 28 can form the graphic, a reverse graphic, and the like.

Figure 2:
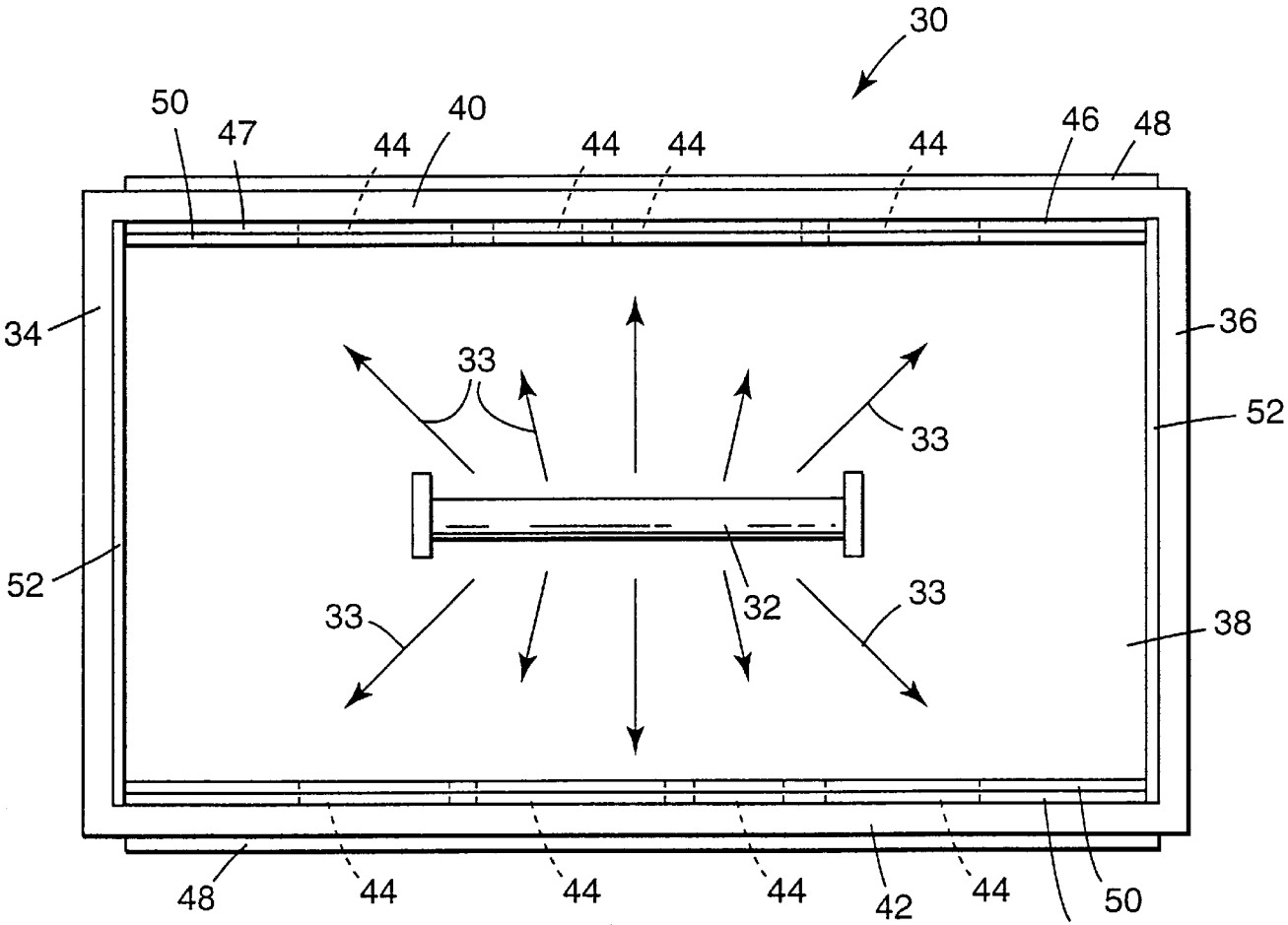
FIG. 2 is a plan view from the top of a sign housing downward to the bottom surface of the sign housing and showing a light source and multiple sign faces that use the benefits of the present invention.

FIG. 2 shows a sign housing 30 opened from the top examination perspective and further shows a light source 32 that projects light (shown as arrows 33) against sides 34 and 36 and bottom 38. Opposing sign faces 40 and 42 both have numerous light-transmissive portions 44 and light-blocking portions 46, either arranged to display the same indicia or graphics or a different indicia or graphics. For example, in a lighted sign identifying the location of an EXIT, the same graphic can be used. Alternatively, one sign face 40 can display a different graphic from the other sign face 42, such as "WELCOME" and "GOODBYE" at the entrance/exit to a building. As shown, sign faces 40 and 42 are translucent and require an opaque film 47 covering light-blocking portions 46.

Optionally, one or both sign faces 40 and 42 can have a diffuser film 48 located on the outside of the sign faces 40 and 42 to diffuse the light from light source 32 emerging from light-transmissive portions 44 of sign faces 40 and 42. Such optional diffuser films are commercially available diffuser films are commercially available from 3M Commercial Graphics Division, St. Paul Minn., USA under the brand Scotchcal™ films in a wide variety of colors. These diffuser films 48 are particularly useful when the light-transmissive portions 46 of sign faces 40 and 42 are made from cutting out a silhouette of the graphic to be back lit from an opaque sheet.

FIG. 2 shows film 50 of the present invention contacting the interior surfaces of both sign faces 40 and 42 at light-blocking portions 46 covered by an opaque film 47, in a similar manner to that seen in FIG. 1 and preferably using an adhesive coating on the surface of film 50 contacting the opaque film 47.

FIG. 2 also shows optional diffuse reflective films 52 contacting sides 34 and 36 to provide reflective surfaces on the vertical surfaces of housing 30. These diffuse reflective films 52 are more completely disclosed in copending, coassigned, U.S. patent application Ser. No. 09/070,380 (Deyak et al.), the disclosure of which is incorporated herein by reference.

While FIG. 2 shows two sign faces 40 and 42, the invention is not so limited. The films of the present invention can be used with multi-faceted signage to provide the advantages of such films to as many sign faces as a sign housing may have. It is not unusual for a sign housing to have as many as 8–10 sides of sign faces to display different information. Such surface area of light-transmissive portions on such multi-faceted signage can benefit even more from the benefits of the present invention because light reflecting within the sign housing is so effectively reflected from the light-blocking portions of the sign faces until such light reaches a light-transmissive portion and through the sign face to the viewer of that particular sign face.

The light-blocking portions 26 or 46 can be made from films that are essentially opaque to light and applied to a surface of the sign face or can be a portion of an opaque sign face that remains when cut out to create the indicia or graphic in a silhouette fashion, such as from aluminum metal. Either way, the light-blocking portions can be covered with films of the present invention in order to provide reflectivity for the ultimate benefit of light traveling through the light-transmissive portions 24 or 44 of the sign face 22, 40, or 42.

As seen in FIGS. 1 and 2, films 28 and 50 are on the inside of sign faces 22, 40, and 42, respectively. Alternatively, films 28 or 50 could be mounted on the outside of a translucent sign face 22, 40, or 42 so long as the highly reflective surface faces inside toward the light housing.

Films 28 and 50 each have two major surfaces. As FIGS. 1 and 2, one major surface has a highly reflective surface without regard to the other major surface because film 28 or film 50 is adhered to an opaque sign face 22 or a sign face 40 or 42 with opaque film 47 adhered to the light-blocking portions 46 of sign face 40 and 42.

Figure 3:
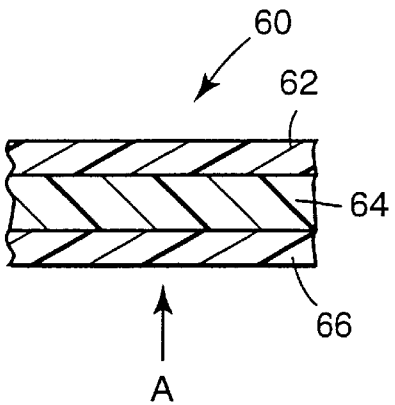
FIG. 3 is a cross-sectional view of an alternate embodiment of the present invention.

Alternatively, as seen in FIG. 3 for a translucent sign face, one major surface has a highly reflective surface 62 and the other major surface 66 has a color or pattern or other background effect as desired by those skilled in the art for use as the light-blocking portions facing the viewer looking the direction shown by arrow A. In this embodiment, film 60 is a multi-layered film having a highly reflective layer 62 contacted to an opaque layer 64 to provide light-blocking properties, which in turn contacts to the other major layer 66 to provide the color, pattern, or background effect for the viewer. Depending on the desired location of the multilayer film 60, adhesive could contact either outer surface of layer 62 for an outside placement on the sign face or outer surface of layer 66 for an inside placement on the sign face. Alternatively, layers 64 and 66 could be combined if the opaque layer 64 has suitable color, pattern, or other background effect. In forming multilayer film 60, layers 62, 64, and 66 can be contacted by adhesion, multilayered extrusion, printing, or using other techniques known to those skilled in the art.

Film

Film 50 can be selected from any film that has the properties of reflectivity and luminance uniformity. Desirably, the film is selected from the group consisting of a diffuse reflective film, a semi-specular reflective film, and a specular reflective film having a diffuse reflective film laminated thereto or a diffused coating coated thereto. Preferably, the film has a reflectivity of at least 80% as measured according to ASTM E1164-94 and more preferably, a reflectivity of at least 90%.

Nonlimiting examples of films with reflectivity of at least 80% include high efficiency optical devices (such as those disclosed in copending, coassigned, U.S. patent application Ser. No. 08/494366, diffusely reflecting multilayer polarizers and mirrors (such as those disclosed in copending, coassigned, U.S. patent application Ser. No. 08/927,436, microporous membranes (such as thermally induced phase separated films as disclosed in copending, coassigned, U.S. patent application Ser. No. 08/957,558, the disclosures of all applications being incorporated by reference herein; polyolefin films filled with white particles (such as Teslin™ brand film sold by PPG of Pittsburgh, Pa., USA); blends of incompatible polymers (such as Melinex™ branded polyester/polypropylene films from DuPont of Wilmington, Del., USA); microvoided polyester films; polyolefin multilayer films (such as Tyvek™ branded polyolefin films commercially available from DuPont of Wilmington, Del., USA); fluorinated polyolefin films (such as polytetrafluoroethylene); vinyl chloride polymeric films filled with white particles; acrylic films filled with white particles; and polyolefin films co-extruded with ethylene-vinyl acetate films (such as disclosed in copending, coassigned, U.S. patent application Ser. No. 08/867,891 (Emslander et al.) incorporated by reference herein); and films having a first birefringent phase and a second phase of differing index of refraction as described in U.S. patent application Ser. Nos. 08/610092, 08/807,268, and 08/807,270 and combinations thereof. All applications are incorporated herein as if fully rewritten.

Preferably, such films are the thermally induced phase separated films identified in the coassigned patent application above and generally disclosed in U.S. Pat. No. 4,539,256 (Shipman et al.), the disclosure of which is incorporated by reference herein.

Films typically have a major surface covered with adhesive. Such adhesive will generally be found on one surface of the film (continuous or portions depending on the embodiment involved) and allows the film to be securely attached to the sign face light-blocking portions. The type of adhesive is selected according to the signage involved, the nature of the substrate, and other factors known to those of skill in the art. For example, a pressure sensitive adhesive may be desired for some applications, and in addition to the pressure sensitive properties the ability to slide or reposition the article before the adhesive sets or cures may also be advantageous. Commercially superior pressure sensitive adhesives for sign graphics are available on image graphic webs marketed under the Scotchcal™ and Scotchcal™ Plus brands from 3M of St. Paul, Minn., USA. Pressure sensitive adhesives having this utility are disclosed in a variety of patents. Among these adhesives are those disclosed in U.S. Pat. Nos. 5,141,790 (Calhoun et al.); 5,229,207 (Paquette et al.); 5,296,277 (Wilson et al.); 5,362,516 (Wilson et al.); 5,800,919 (Peacock et al.); PCT Patent Publication WO 97/18246; and copending, coassigned U.S. patent application Ser. Nos. 08/775,844 (Sher et al.); and 08/606,988, the disclosures of all of which are incorporated by reference herein. A release liner may also be applied to protect the adhesive layer until needed.

Alternatively to adhesives, mechanical fasteners can be used if laminated in some known manner to that opposing major surface of the film of the present invention. Nonlimiting examples of mechanical fasteners include Scotchmate™ and Dual Lock™ fastening systems, as disclosed in PCT Patent Publication WO 98/39759, from which application Ser. No. 08/930957 (Loncar) was filed, the disclosures of which are incorporated by reference herein.

With adhesive, such films have a thickness ranging from about 25 $\mu$m to about 500 $\mu$m and preferably from about 75 $\mu$m to about 375 $\mu$m. This thickness permits the adhesive-backed film to be applied to sign face 20, 40, or 42 without substantially altering the dimension inside the housing for the sign 10 or 30 to remain in compliance with electrical codes and other regulations.

Usefulness of the Invention

The use of reflective films on non-transmitting internal surfaces of a sign face results in a brighter, more energy efficient sign. Further, the sign housing can operate at a lower temperature than one would have with the current construction of a black blockout film facing toward the interior of the sign. This dark surface absorbs energy (light and IR), heating the cavity, and requires more wattage, than the construction using the invention, for equal luminance. In a sign housing where the internal surface of the sign face is lined with a reflective film 50 of the present invention, the light from the bulbs hits the sign face and, where the sign face is light-transmissive, some portion of the light is passed through to the viewer. Where and when the light hits the reflective film 50 on the light-blocking portions, that light is efficiently reflected back into the sign cavity for further re-direction via reflection until ultimately transmitted through the light-transmissive portions of the sign face. This recycling of the light in the sign housing results in more light coming out the front and the sign box stays cooler. The advantages of this invention are further enhanced with use of diffusely reflective film lining other surfaces of the sign housing according to the disclosure of copending, coassigned, U.S. patent application Ser. No. 09/070,380 (Deyak et al.), the disclosure of which is incorporated herein by reference.

Further embodiments are found in the following examples.

Examples 1–2 and Comparative Examples A–B

These examples compared four conditions of a sign housing in the form of a rectangular box-shaped sign cabinet with and without the reflective film of the present invention, with and without diffuse reflective film on other surfaces inside the sign cabinet.

The light measurements were made with a sign cabinet with a single sign face. The sign box was 35 cm wide, 35 cm tall, and 6 cm deep with a imageable plastic sign face that slid in place with light bulbs enclosed therein to make a back lit sign. The cabinet was lit with 2.5×30 cm fluorescent bulbs. The sign face was an acrylic sheet with translucent red letters surrounded by a white opaque background. The red lettering was laminated to the first surface of the acrylic sheet facing outside of the sign cabinet. The translucent red lettering comprised about 33% of the total surface area of the sign face, the remaining 67% being opaque. Thus, the light-transmissive portions of the sign face were 33%; the light-blocking portions 67% for these Examples 1–2 and Comparison Examples A–B.

For comparison, two different versions of the white opaque film were laminated to the second surface of the acrylic sheet facing inside of the sign cabinet. One version, representing the current practice in the art, used 3M Blockout Film 3635-20B (3M Commercial Graphics Division, St. Paul, Minn., USA) with the black surface facing the lights inside the sign cabinet and the white surface facing outward. The second version, representing an embodiment of the present invention, used a composite of the same Blockout Film 3635-20B and a white highly reflective diffuser film produced according to U.S. Pat. No. 4,539,256 (Shipman et al.) laminated on top of the 3635-20B film, thereby providing both a white surface facing back toward the lights and forward toward the viewer of the sign.

The remainder of the sign cabinet also had two versions: one with the sides and back of the sign cabinet lined with a white diffuse reflective film according to the disclosure of copending, coassigned, U.S. patent application Ser. No. 09/070,380 (Deyak et al.), and the second without the reflective film but having the pre-existing white paint painted by Clearr Corporation of Minnetonka, Minn., USA which has a reflectivity of approximately 78%. Table 1 shows the 4 experimental conditions.

TABLE 1

| Example | Sign Face | Side/Back Surfaces |
|---|---|---|
| A | Blockout Only | White Paint |
| 1 | Laminate of Blockout Film and Reflective Film | White Paint |
| B | Blockout Only | Lined with Diffuse Reflective Film |
| 2 | Laminate of Blockout Film and Reflective Film | Lined with Diffuse Reflective Film |

Each of the four combinations were tested by turning on the Cool White F13T8/CW fluorescent tube from Osram/Sylvania for one hour and then measuring luminance at 8 different locations on the sign face where the red translucent film was located. The same locations were used for each of the four combinations. The readings used a Minolta LS110 light meter measuring light output in luminance (foot lamberts converted to candela/m$^2$) at 550 nm. An average of the eight readings was used for comparison among Examples 1–2 and Comparative Examples A–B. Comparison Example A (without any reflective film on the sign face and without diffuse reflective film on other surfaces of the sign cabinet) served as the control for percentage comparisons. Table 2 shows the experiment results.

TABLE 2

| Example | Average Luminance (Candela/m$^2$ converted from foot-lamberts) | Percent Increase in Average Luminance |
|---|---|---|
| A | 213.4 | 0% (Control) |
| 1 | 271.3 | 27% |
| B | 285.7 | 34% |
| 2 | 487.2 | 128% |

For a sign face having 33% total surface area as light-transmissive portions, Example 1 showed a 27 percent improvement by providing the light-blocking portions of the sign face with a reflective film rather than the black blockout film of Comparison Example A. Example 1 is comparable with Comparison Example B in average luminance, but both Example 1 and Comparison Example B are unexpectedly eclipsed by the results of Example 2 that shows a tremendous increase in average luminance when the sign cabinet is configured to take advantage of reflectivity properties of film located both on the sign face at light-blocking portions of that surface and on other interior surfaces as taught by copending, coassigned, U.S. patent application Ser. No. 09/070,380 (Deyak et al.).

The invention is not limited the embodiments. The claims follow.

What is claimed is:

1. A lighted sign housing, comprising:

(a) a sign face having both light-transmissive portions and light-blocking portions;

(b) a highly reflective film applied to at least a portion of the light-blocking portions of an interior surface of the sign face, wherein the highly reflective film is selected from the group consisting of a diffuse reflective film, a specular reflective film having a diffuse film laminated thereto and a specular reflective film having a diffused coating coated thereto; and (c) interior walls having a highly reflective film applied thereto, wherein the highly reflective film is selected from the group consisting of a diffuse reflective film, a specular reflective film having a diffuse film laminated thereto and a specular reflective film having a diffused coating coated thereto, wherein the highly reflective film applied to the interior walls and the highly reflective film applied to at least a portion of the light-blocking portions of the interior surface increase the average luminance of light passing through the light-transmissive portions and also provide enhanced luminance uniformity on the light-transmissive portions in comparison to a lighted sign housing having non-diffuse reflective films.

2. The lighted sign housing of claim 1, wherein the highly reflective film is a diffuse reflective film having a reflectivity of at least 80% as measured using ASTM E1164-94.

3. The lighted sign housing of claim 2, wherein the highly reflective film is selected from the group consisting of polyolefin films filled with white particles, blends of incompatible polymers, polyolefin multilayer films; polyester multilayer films; microvoided polyolefin and polyester films; fluorinated polyolefin films; vinyl chloride polymeric films filled with white particles; acrylic films filled with white particles; polyolefin films co-extruded with ethylene-vinyl acetate films; and combinations thereof.

4. The lighted sign housing of claim 1, wherein the highly reflective film on the interior walls of the lighted sign housing has a reflectivity of at least 90% as measured using ASTM E1164-94.

5. The lighted sign housing of claim 1, further comprising:

(c) one or more additional sign face(s), each additional sign face having both light-transmissive portions and light-blocking portions; and (d) a highly reflective film applied to at least a portion of the light-blocking portions of interior surface of each additional sign face, wherein the highly reflective film is selected from the group consisting of a diffuse reflective film, a specular reflective film having a diffuse film laminated thereto and a specular reflective film having a diffused coating coated thereto.

6. The lighted sign housing of claim 1, wherein the highly reflective film is adhered to light-blocking portions of the sign face by an adhesive.

7. The lighted sign housing of claim 1, wherein the highly reflective film has fasteners laminated thereto on a major surface for fastening the highly reflective film to the sign face.

8. The lighted sign housing of claim 1, wherein the highly reflective film on the sign face is multilayered and includes an opaque layer.

9. The lighted sign housing of claim 1, wherein the highly reflective film on the sign face has a thickness ranging from about 25 $\mu$m to about 500 $\mu$m.

* * * * *

UNITED STATES PATENT AND TRADEMARK OFFICE

CERTIFICATE OF CORRECTION

PATENT NO. : 6,598,328 B2
DATED : July 29, 2003
INVENTOR(S) : Aeling, Ellen O.

It is certified that error appears in the above-identified patent and that said Letters Patent is hereby corrected as shown below:

Column 2,
Line 57, begin new paragraph with "Film".

Column 3,
Line 34, delete "to viewed" and insert in place thereof -- to be viewed --.

Signed and Sealed this

First Day of June, 2004

JON W. DUDAS
*Acting Director of the United States Patent and Trademark Office*